US010781385B2

(12) United States Patent
Garcia Castro et al.

(10) Patent No.: US 10,781,385 B2
(45) Date of Patent: Sep. 22, 2020

(54) COPOLYMERS COMPRISING A-OLEFINS AND OLEFIN DICARBOXYLIC ACID ESTERS, PRODUCTION THEREOF, AND USE THEREOF AS POUR POINT DEPRESSANTS FOR CRUDE OILS, MINERAL OILS, OR MINERAL OIL PRODUCTS

(71) Applicant: BASF SE, Ludwigshafen am Rhein (DE)

(72) Inventors: Ivette Garcia Castro, Ludwigshafen (DE); Kai Gumlich, Dubai (AE); Stefan Frenzel, Mannheim (DE); Maria Heuken, Schwarzheide (DE); Rouven Konrad, Mörstadt (DE); Karin Neubecker, Frankenthal (DE); Edward Bohres, Ludwigshafen (DE); Adam Blanazs, Mannheim (DE)

(73) Assignee: BASF SE (DE)

( * ) Notice: Subject to any disclaimer, the term of this patent is extended or adjusted under 35 U.S.C. 154(b) by 50 days.

(21) Appl. No.: 15/778,723

(22) PCT Filed: Nov. 17, 2016

(86) PCT No.: PCT/EP2016/077935
§ 371 (c)(1),
(2) Date: May 24, 2018

(87) PCT Pub. No.: WO2017/089212
PCT Pub. Date: Jun. 1, 2017

(65) Prior Publication Data

US 2018/0355266 A1 Dec. 13, 2018

(30) Foreign Application Priority Data

Nov. 27, 2015 (EP) ..... 15196769

(51) Int. Cl.
*C10L 1/196* (2006.01)
*C10L 10/04* (2006.01)
*C10L 10/16* (2006.01)
*C10L 10/14* (2006.01)

(52) U.S. Cl.
CPC ..... *C10L 1/1966* (2013.01); *C10L 10/04* (2013.01); *C10L 10/14* (2013.01); *C10L 10/16* (2013.01); *C10L 2200/0453* (2013.01); *C10L 2230/14* (2013.01); *C10L 2270/026* (2013.01); *C10L 2270/10* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,542,542 | A | 2/1951 | Lippincott et al. | |
| 2005/0138859 | A1* | 6/2005 | Jackson | C10L 1/143 44/389 |
| 2011/0190182 | A1 | 8/2011 | Price et al. | |
| 2017/0009067 | A1 | 1/2017 | Garcia Castro et al. | |

FOREIGN PATENT DOCUMENTS

| | | | |
|---|---|---|---|
| CA | 1238448 | A | 6/1988 |
| CA | 2889773 | A1 | 6/2014 |
| DE | 2102469 | A1 | 8/1972 |
| EP | 0075217 | A2 | 3/1983 |
| EP | 84148 | A2 | 7/1983 |
| EP | 214786 | A1 | 3/1987 |
| EP | 1746147 | A1 | 1/2007 |
| GB | 1368159 | A | 9/1974 |
| GB | 1468588 | A | 3/1977 |
| WO | WO-2014095408 | A1 | 6/2014 |

OTHER PUBLICATIONS

International Search Report for PCT/EP2016/077935 dated Jan. 18, 2017.
Written Opinion of the International Searching Authority for PCT/EP2016/077935 dated Jan. 18, 2017.

* cited by examiner

*Primary Examiner* — Ellen M McAvoy
*Assistant Examiner* — Chantel L Graham
(74) *Attorney, Agent, or Firm* — Faegre Drinker Biddle & Reath LLP

(57) ABSTRACT

Copolymers comprising $C_{14}$ to $C_{50}$ olefins and at least two different olefindicarboxylic esters and optionally maleic acid or maleic acid derivatives. The olefindicarboxylic esters are firstly esters with linear $C_{18}$- to $C_{50}$-alkyl groups and secondly esters with short-chain linear, branched or cyclic alkyl groups, or esters with aromatic groups. The invention further relates to a process for preparing copolymers of this kind and to the use thereof as pour point depressant for crude oil, mineral oil and/or mineral oil products, preferably as pour point depressant for crude oil.

11 Claims, No Drawings

COPOLYMERS COMPRISING A-OLEFINS AND OLEFIN DICARBOXYLIC ACID ESTERS, PRODUCTION THEREOF, AND USE THEREOF AS POUR POINT DEPRESSANTS FOR CRUDE OILS, MINERAL OILS, OR MINERAL OIL PRODUCTS

CROSS-REFERENCE TO RELATED APPLICATIONS

This application is a national stage application (under 35 U.S.C. § 371) of PCT/EP2016/077935, filed Nov. 17, 2016, which claims benefit of European Application No. 15196769.2, filed Nov. 27, 2015, both of which are incorporated herein by reference in their entirety.

The present invention relates to copolymers comprising $C_{14}$ to $C_{50}$ olefins and at least two different olefindicarboxylic esters, and optionally maleic acid or maleic acid derivatives. The olefindicarboxylic esters are firstly esters with linear $C_{18}$- to $C_{50}$-alkyl groups and secondly esters with short-chain linear, branched or cyclic alkyl groups, or esters with aromatic groups. The invention further relates to a process for preparing copolymers of this kind and to the use thereof as pour point depressant for crude oil, mineral oil and/or mineral oil products, preferably as pour point depressant for crude oil.

The deposit temperature of oil deposits is generally above room temperature, for example 40° C. to 100° C. Crude oil is produced from such deposits while still warm, and it naturally cools more or less quickly to room temperature in the course of or after production, or else to lower temperatures under corresponding climatic conditions.

According to their origin, crude oils have different proportions of long-chain n-paraffins. According to the type of crude oil, the proportion of such paraffins may typically be 1% to 30% by weight of the crude oil. They are frequently also referred to as waxes. When the temperature goes below a particular level in the course of cooling, the paraffins can crystallize, typically in the form of platelets. The precipitated paraffins considerably impair the flowability of the oil. The platelet-shaped n-paraffin crystals can form a kind of house-of-cards structure which encloses the crude oil, such that the crude oil ceases to flow, even though the predominant portion is still liquid. Precipitated paraffins can also block filters, pumps, pipelines and other installations or be deposited in tanks, thus entailing a high level of cleaning.

The lowest temperature at which a sample of an oil still just flows in the course of cooling is referred to as the pour point. For the measurement of the pour point, standardized test methods are used. Crude oils can have pour points above room temperature. Crude oils of this kind can solidify in the course of or after conveying.

It is known that the pour point of crude oils can be lowered by suitable additives. This can prevent paraffins from precipitating in platelet-like form in the course of cooling of produced crude oil. Suitable additives firstly prevent the formation of said house-of-cards-like structures and thus lower the temperature at which the crude oil solidifies. In addition, additives can promote the formation of fine, well-crystallized, non-agglomerating paraffin crystals, such that undisrupted oil transport is ensured. Such additives are referred to as pour point depressants or flow improvers.

Paraffin inhibitors or wax inhibitors refer to those substances intended to prevent the deposition of paraffins or paraffin waxes on surfaces in contact with crude oils or other wax-containing oils and/or mineral oil products.

The use of ethylene copolymers as flow improvers is known, especially that of copolymers of ethylene and unsaturated esters. Examples thereof are described in DE-A-21 02 469 or EP 84 148 A2.

It is also known that copolymers of olefins and esters of ethylenically unsaturated dicarboxylic acids can be used for this purpose.

GB 1 468 588 discloses a middle oil distillate which, for improvement of the low-temperature properties, comprises an MA-olefin copolymer which has been esterified with $C_{18}$ to $C_{44}$ alcohols. One example discloses a copolymer of MA, $C_{22/28}$-α-monoolefins and behenyl alcohol.

U.S. Pat. No. 2,542,542 discloses copolymers of dodecene, tetradecene, hexadecene or octadecene and maleic anhydride as addition to lubricant oils.

EP 214 786 A1 discloses the use of copolymers of straight-chain olefins, for example 1-octene, 1-decene, 1-dodecene, 1-tetradecene or 1-octadecene, and maleic esters for improving the low-temperature properties of fuels. The alcohols used for esterification have at least 10 carbon atoms and they may be linear or branched. The document discloses that a mixture of linear and singly methyl-branched alcohols can be used.

EP 1 746 147 A1 discloses the use of copolymers of olefins and esters of ethylenically unsaturated dicarboxylic acids for lowering the cloud point of fuel oils and lubricants. The copolymers comprise, as monomers, $C_3$ to $C_{50}$ olefins, preferably $C_8$ to $C_{30}$ olefins, and $C_1$ to $C_{40}$ mono- or diesters of ethylenically unsaturated dicarboxylic acids, especially of maleic acid. The $C_1$ to $C_{40}$ hydrocarbyl radicals of the ester groups are preferably linear or branched $C_1$- to $C_{40}$-alkyl radicals. There is no disclosure of copolymers comprising both linear and branched alkyl radicals, and the document does not comprise any details at all as to the molecular weight of the products obtained. The copolymers described are prepared by first reacting the olefins with maleic anhydride to give an olefin-MA copolymer and, in a second step, reacting them with alcohols in o-xylene (flashpoint about 30° C.) as solvent. The ring of the copolymerized MA units is opened here. The o-xylene can be removed on conclusion of reaction. The document further describes additive packages in which the said copolymers, optionally with further components, are formulated in suitable diluents. Diluents may, for example, be aliphatic or aromatic solvents or alkoxyalkanols.

Such copolymers for use as pour point depressants are typically prepared in chemical production sites, and the products are transported from there to the site of use, for example to an oilfield or to an offshore platform. Such sites of use may be in cold regions of the Earth. In order to save transport costs, concentrates of the copolymers in hydrocarbons are typically produced. Such concentrates can be formulated by users on site in the desired manner to give ready-to-use formulations. For example, dilution with solvent and/or addition of further additives is possible.

Particularly advantageous pour point depressants can be obtained by using $C_{20}$ to $C_{24}$ olefins and $C_{16}$ to $C_{28}$ alcohols to prepare said copolymers.

Ready-to-use formulations may comprise, for example, about 20% by weight of said copolymers in high-boiling organic solvents. High-boiling organic solvents are used because they also have a high flashpoint. More particularly, solvents having a flashpoint of at least 60° C. are frequently used. Formulations of this kind have the drawback of being able to solidify when handled in a cold environment, for example in an Arctic environment, which is extremely undesirable. The problem could be solved, for example, through the use of formulations having a lower concentration of polymers. But this requires greater amounts of solvents, and so this solution must by its nature be more costly. Higher costs are also the result of changes in the infrastructure, for example heated conduits.

It was therefore an object of the present invention to provide improved formulations of modified olefin-MA copolymers for use as pour point depressants for crude oils in high-boiling organic solvents. The formulations, at a concentration of about 20% by weight of copolymers—with essentially the same effect as a pour point depressant—were to have a lower solidification temperature than known formulations.

It has been found that, surprisingly, this can be achieved through minor changes in the polymer architecture.

Accordingly, in a first aspect of the invention, copolymers (X) have been found, comprising, as monomers, at least (A) 40 to 60 mol %, based on the amount of all monomers, of at least one α-olefin (A) of the general formula $H_2C{=}CH{-}R^1$ where $R^1$ is at least one linear, cyclic or branched, aliphatic and/or aromatic hydrocarbyl radical having 14 to 50 carbon atoms, and (B) 60 to 40 mol %, based on the amount of all monomers, of monoethylenically unsaturated dicarboxylic acids or derivatives thereof, and wherein the monomers (B) are (B1) at least one monomer $(R^2OOC)R^5C{=}CR^6(COOR^4)$, (B2) at least one monomer $(R^3OOC)R^5C{=}CR^6(COOR^4)$ and (B3) optionally at least one monomer selected from the group of $(HOOC)R^5C{=}CR^6(COOH)$ (B3a) and (B3b)

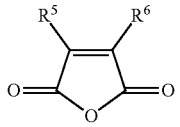

where $R^2$ is a linear alkyl radical having 16 to 36 carbon atoms, $R^3$ is a radical selected from the group consisting of $R^{3a}$: linear 1-alkyl radicals having 1 to 10 carbon atoms, $R^{3b}$: branched and/or secondary alkyl radicals having 4 to 36 carbon atoms, $R^{3c}$: unsubstituted or alkyl-substituted, cyclic alkyl radicals having 5 to 18 carbon atoms, or $R^{3d}$: unsubstituted or alkyl-substituted, aromatic hydrocarbyl radicals having 6 to 36 carbon atoms, $R^4$ in each case is a radical selected from the group of H, $R^2$ and $R^3$, with the proviso that at least 50 mol % of the $R^4$ radicals are H, $R^5$ and $R^6$ are each H or methyl, the proportion of the $R^3$ radicals based on the sum total of the $R^2$ and $R^3$ radicals is 1 mol % to 49 mol %, the proportion of the monomers (B1)+(B2) based on the sum total of all monomers (B) is at least 50 mol %, and the weight-average molecular weight $M_w$ of the copolymers (X) is 2000 g/mol to 25 000 g/mol.

In a second aspect of the invention, a composition composed of the copolymer (X) described and organic solvents (Y), especially hydrocarbons having a flashpoint 60° C., has been found.

In a third aspect of the invention, a process for preparing copolymers (X) of this kind has been found, comprising at least the following process steps:

I) providing a polymeric reactant by polymerizing at least the following monomers:

40 to 60 mol %, based on the amount of all α-olefin monomers $H_2C{=}CH{-}R^1$ (A) used, where $R^1$ is at least one linear, cyclic or branched, aliphatic and/or aromatic hydrocarbyl radical having 14 to 50 carbon atoms, and 60 to 40 mol % of (B3b)

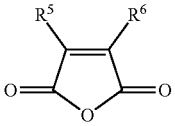

where $R^5$ and $R^6$ are as defined above, where the number-average molecular weight $M_n$ of the polymeric reactant is 1000 g/mol to 15 000 g/mol, II) polymer-analogous esterification of the polymeric reactant provided in stage I at 130° C. to 180° C. with at least one alcohol $R^2OH$ where $R^2$ is a linear alkyl radical having 18 to 36 carbon atoms, and at least one alcohol $R^3OH$, selected from the group of $R^{3a}OH$ where $R^{3a}$ represents linear 1-alkyl radicals having 1 to 10 carbon atoms, $R^{3b}OH$ where $R^{3b}$ represents branched and/or secondary alkyl radicals having 4 to 36 carbon atoms, $R^{3c}OH$ where $R^{3c}$ represents unsubstituted or alkyl-substituted, cyclic alkyl radicals having 5 to 18 carbon atoms, and $R^{3d}OH$ where $R^{3d}$ is an unsubstituted or alkyl-substituted aromatic hydrocarbyl radical having 6 to 36 carbon atoms, where the proportion of the alcohols $R^3OH$ based on the sum total of the alcohols $R^2OH$ and $R^3OH$ is 1 mol % to 49 mol %, and the amount of the alcohols $R^2OH$ and $R^3OH$ used together is 0.5 to 1.5 mol/mol of (B3b).

In addition, copolymers (X) obtainable by means of the process described have been found.

In a further aspect of the invention, the use of copolymers (X) of this kind as a pour point depressant for crude oil, mineral oil and/or mineral oil products, especially as a pour point depressant for crude oils and for avoidance of wax deposits on surfaces, has been found.

Specific details of the invention are as follows:

The inventive copolymers (X) have been formed from ethylenically unsaturated monomers. They comprise, as monomers, at least one α-olefin (A) and at least two different olefindicarboxylic esters (B1) and (B2). In addition, it is optionally also possible for maleic acid, maleic anhydride or the corresponding methyl-substituted derivatives and/or further ethylenically unsaturated monomers, especially monoethylenically unsaturated monomers, to be included in the copolymer (X).

Monomers (A)

The monomers (A) are α-olefins having the general formula $H_2C{=}CH{-}R^1$. In this case, $R^1$ is a linear, cyclic or branched, aliphatic and/or aromatic hydrocarbyl radical having 14 to 50, especially 16 to 30 carbon atoms, preferably 18 to 30 carbon atoms and more preferably 18 to 28 carbon atoms.

Preference is given to linear or branched alkyl radicals, particular preference to linear alkyl radicals having 14 to 50 carbon atoms, especially linear alkyl radicals having 16 to 30 carbon atoms, preferably 18 to 30 carbon atoms, more preferably 18 to 28 carbon atoms and, for example, 18 to 24 carbon atoms.

According to the invention, it is possible to use a single α-olefin, or else it is possible to use mixtures of two or more different α-olefins of the general formula $H_2C{=}CH{-}R^1$.

Advantageously, it is possible to use mixtures comprising at least two and preferably at least three α-olefins having alkyl radicals $R^1$, preferably linear alkyl radicals $R^1$, having 16 to 30 carbon atoms, preferably 18 to 24 carbon atoms.

The mixtures may especially be technical grade mixtures of linear aliphatic α-olefins. Technical grade mixtures of this kind comprise, as main constituents, aliphatic α-olefins having an even number of carbon atoms. It is advantageously possible to use a technical grade mixture comprising at least three α-olefins of the general formula $H_2C{=}CH{-}R^1$ in which the $R^1$ radicals are n-octadecyl, n-eicosyl and n-docosyl radicals (i.e. a mixture of linear aliphatic $C_{20}$, $C_{22}$ and $C_{24}$ α-olefins), especially mixtures comprising at least 80% by weight, preferably at least 90% by weight, of said α-olefins, based on the amount of all olefins.

Monomers (B)

The monomers (B) are monoethylenically unsaturated dicarboxylic acids or derivatives. According to the invention, the monomers (B) are at least two different monomers (B1) and (B2). In addition, it is optionally also possible for monomers (B3) to be present. Aside from (81), (B2) and optionally (B3), no further monomers (B) are present.

According to the invention, the monomers (B1) and (B2) are at least one monomer of the general formula $(R^2OOC)R^5C{=}CR^6(COOR^4)$ (B1), and at least one monomer of the general formula $(R^3OOC)R^5C{=}CR^6(COOR^4)$ (B2).

In formulae (B1) and (B2), $R^5$ and $R^6$ are each H or methyl; preferably, $R^5$ and $R^6$ are each H.

According to the position of the substituents on the double bond, the isomers are E or Z isomers.

In (B1), $R^2$ is a linear n-alkyl radical having 16 to 36 carbon atoms, preferably 16 to 32 carbon atoms, especially 16 to 26 carbon atoms.

Examples of radicals of this kind include n-hexadecyl, n-heptadecyl, n-octadecyl, n-nonadecyl, n-eicosyl, n-heneicosyl, n-docosyl, n-tetracosyl, n-hexacosyl, n-octacosyl or n-triacontyl radicals.

In one embodiment of the invention, $R^2$ is at least one linear n-alkyl radical having 16 to 22 carbon atoms.

In a further embodiment of the invention, $R^2$ is at least one linear n-alkyl radical having 22 to 26 carbon atoms.

In (B2), $R^3$ is at least one radical selected from the group of $R^{3a}$, $R^{3b}$, $R^{3c}$ and $R^{3d}$, preferably selected from $R^{3b}$ and $R^{3c}$.

$R^{3a}$ comprises linear 1-alkyl radicals having 1 to 10 carbon atoms, preferably 2 to 10 and more preferably 2 to 6 carbon atoms.

Examples of linear 1-alkyl radicals $R^{3a}$ include ethyl, n-propyl, n-butyl, n-pentyl, n-hexyl, n-heptyl, n-octyl, n-nonyl and n-decyl radicals, preference being given to n-propyl, n-butyl, n-pentyl, n-hexyl, n-heptyl, n-octyl, n-nonyl and n-decyl radicals, particular preference to ethyl, n-propyl, n-butyl, n-pentyl and n-hexyl radicals and very particular preference to n-butyl radicals.

$R^{3b}$ comprises branched and/or secondary alkyl radicals having 4 to 36 carbon atoms, preferably 4 to 30, more preferably 4 to 17 carbon atoms.

Branched alkyl radicals may be singly or multiply branched. Examples of branched alkyl radicals $R^{3b}$ include i-butyl, t-butyl, 2,2'-dimethylpropyl, 2-ethylhexyl, 2-propylheptyl, i-nonanol, i-decyl, i-tridecyl, i-heptadecyl radicals, preference being given to t-butyl, 2-ethylhexyl and 2-propylheptyl radicals.

Examples of secondary alkyl radicals included 2-butyl, 2-propyl, 2-hexyl, 2-heptyl or 2-dodecyl radicals.

$R^{3a}$ comprises unsubstituted or alkyl-substituted, cyclic alkyl radicals having 5 to 18 carbon atoms, preferably 6 to 10 carbon atoms. It especially comprises unsubstituted or alkyl-substituted cyclic alkyl radicals comprising 5-, 6- or 7-membered rings. It may also comprise bicyclic radicals. Examples of $R^{3a}$ radicals include cyclopentyl, cyclohexyl, cycloheptyl, bornyl or myrtanyl radicals. Preferably, $R^{3a}$ may be a cyclohexyl radical.

$R^{3d}$ comprises unsubstituted or alkyl-substituted, aromatic hydrocarbyl radicals having 6 to 36 carbon atoms. Examples of such radicals include phenyl, benzyl or tolyl radicals.

$R^4$ in each of the formulae (B1) and (B2) is a radical selected from the group of H, $R^2$ and $R^3$, where $R^2$ and $R^3$ have the meaning defined above, with the proviso that in each case 50 mol %, preferably at least 75 mol % and more preferably at least 95 mol % of the $R^4$ radicals are H. In one embodiment of the invention, all $R^4$ radicals are H.

If $R^4$ in (B1) or (B2) is H, (B1) and (B2) are thus monoesters. If $R^4$ in (B1) or (B2) is $R^2$ or $R^3$, they are diesters.

When $R^4{=}H$, the monomers (B1) and (B2) comprise COOH groups. According to the medium, the COOH groups may of course be dissociated, and they may also be in salt form as —COO— 1/m $X^{m+}$ where $X^{m+}$ is an m-valent cation. For example, $X^{m+}$ may comprise alkali metal ions such as $Na^+$, $K^+$, or ammonium ions.

The monomers (B3) that are optionally present are at least one monomer selected from $$(HOOC)R^5C{=}CR^6(COOH) \quad \text{(B3a) and}$$

(B3b)

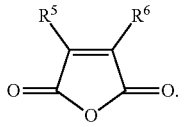

These are thus maleic acid and/or maleic anhydride or the corresponding methyl-substituted derivatives.

The proportion of the monomers (B1)+(B2) based on the sum total of all monomers (B) (i.e. the sum total of (B1), (B2) and (B3)) is at least 50 mol %, preferably at least 80 mol %, more preferably at least 95 mol %, and most preferably exclusively monomers (B1) and (B2) are present.

The proportion of the $R^3$ radicals based on the sum total of the $R^2$ and $R^3$ radicals is 1 mol % to 49 mol %, especially 5 mol % to 45 mol %, preferably 20 mol % to 45 mol % and, for example, 30 mol % to 40 mol %.

There may be just one monomer (B1), or there may be two or more different monomers (B1) having various $R^2$ radicals.

In one embodiment, there are at least two, preferably at least three, different monomers (B1) having different $R^2$ radicals, where $R^2$ in this embodiment comprises 16 to 30 carbon atoms, for example 16 to 22 carbon atoms or, for example, 20 to 28 carbon atoms, especially 22 to 26 carbon atoms.

In one embodiment of the invention, there are at least three different monomers (B1), specifically at least one monomer (B1) in which $R^2$ is an n-docosyl radical, a monomer (B1) in which $R^2$ is an n-tetracosyl radical, and a monomer (B1) in which $R^2$ is an n-hexacosyl radical.

There may be just one monomer (B2), or there may be two or more different monomers (B2) having different $R^3$ radicals.

In one embodiment of the invention, the $R^3$ radicals are $R^{3a}$ radicals.

In one embodiment of the invention, the $R^3$ radicals are $R^{3b}$ radicals and/or $R^{3c}$ radicals.

In one embodiment of the invention, the $R^3$ radicals are $R^{3b}$ radicals.

In one embodiment of the invention, the $R^3$ radicals are $R^{3c}$ radicals.

In one embodiment of the invention, the $R^3$ radicals are $R^{3d}$ radicals.

Further Monomers (C)

In addition to the monomers (A) and (B), it is optionally also possible for further ethylenically unsaturated, especially monoethylenically unsaturated, monomers (C) to be present. Mention should be made here of derivatives of olefindicarboxylic acids other than the monomers (B). Mention should also be made of α-olefins other than the α-olefins (A), for example methyl undecenoate. It is additionally possible to use vinyl ethers, vinyl esters, N-vinyl comonomers such as vinylpyrrolidones, vinylcaprolactams, isobutene, diisobutene or polyisobutene.

Copolymers (X)

In the copolymers (X) of the invention, the proportion of the monomers (A) based on the amount of all monomers is 40 mol % to 60 mol %, preferably 45 mol % to 55 mol % and, for example, 48 mol % to 52 mol %.

The proportion of the monomers (B) based on the amount of all monomers is 40 mol % to 60 mol %, preferably 45 mol % to 55 mol % and, for example, 48 to 52 mol %.

If they are present at all, the amount of additional monomers (C) is not more than 20 mol %, preferably not more than 10 mol %, more preferably not more than 5 mol %, and most preferably no further monomers (C) are present.

According to the invention, the weight-average molecular weight $M_w$ of the copolymers (X) is 2000 g/mol to 25 000 g/mol, preferably 4000 g/mol to 20 000 g/mol and, for example, 10 000 to 20 000 g/mol.

One embodiment of the invention concerns a copolymer (X) of the type described, in which the proportion of the monomers (B1)+(B2) based on the sum total of all monomers (B) is at least 95 mol %, and in which at least 95 mol % of the $R^4$ radicals are H.

In other words, this embodiment concerns copolymers (X) containing at most small amounts of maleic anhydride and/or maleic acid or the corresponding methyl derivatives, and in which the olefindicarboxylic ester units are monoesters in particular.

A further embodiment of the invention concerns a copolymer (X) of the type described, in which the proportion of the monomers (B1)+(B2) based on the sum total of all monomers (B) is at least 95 mol %, at least 95 mol % of the $R^4$ radicals are H, the copolymer comprises at least two different α-olefins $H_2C{=}CH{-}R^1$ where $R^1$ represents linear alkyl radicals having 16 to 30 carbon atoms, preferably 18 to 28 carbon atoms and more preferably 18 to 24 carbon atoms, and the copolymer comprises at least two different monomers (B1) where $R^2$ in each case comprises 16 to 32 carbon atoms, preferably 16 to 26 carbon atoms, $R^3$ is a radical selected from the group of $R^{3b}$: branched and/or secondary alkyl radicals, preferably branched alkyl radicals having 4 to 36, preferably 4 to 30, more preferably 4 to 17, carbon atoms, and $R^{3c}$: unsubstituted or alkyl-substituted, cyclic alkyl radicals having 5 to 18, preferably 6 to 10, carbon atoms, especially a cyclohexyl radical.

Composition Comprising Olefin-Olefindicarboxylic Ester Copolymers (X) and Hydrocarbons In a further aspect, the invention relates to a composition for use as a pour point depressant, at least comprising at least one copolymer (X), and at least one organic solvent (Y).

The copolymers (X) of the invention and preferred embodiments of the copolymers (X) have already been described above, and so reference is merely made to the above description at this point.

The organic solvents (Y) may in principle be any organic solvents, provided that the copolymers (X) are soluble therein. Preference is given to using solvents having a flashpoint ≥60° C.

Organic solvents (Y) may be hydrocarbons. Examples of hydrocarbons include aliphatic, cycloaliphatic and/or aromatic solvents. In addition, it is also possible to use organic solvents comprising functional groups, for example alcohols or esters.

In one embodiment of the invention, the organic solvents are nonpolar solvents (Y1) comprising saturated aliphatic hydrocarbyl groups, preferably those having a flashpoint ≥60° C. Examples of such solvents (Y1) include saturated aliphatic alcohols or esters of saturated aliphatic carboxylic acids and saturated aliphatic alcohols, with the proviso that the solvents preferably each have a flashpoint ≥60° C. Examples of esters comprise esters of saturated fatty acids having at least 8 carbon atoms with saturated aliphatic alcohols, for example methyl laurate or methyl stearate. Technical grade mixtures of various aliphatic esters are commercially available. In one embodiment of the invention, solvents used may be esters of aliphatic or cycloaliphatic dicarboxylic acids, for example dialkyl esters of cyclohexane-1,2-dicarboxylic acid, such as diisononyl cyclohexane-1,2-dicarboxylate.

In one embodiment of the invention, the organic solvents (Y) are saturated aliphatic hydrocarbons (Y1) or mixtures thereof. These may be either paraffinic or naphthenic, i.e. saturated cyclic, hydrocarbons. Preferred hydrocarbons (Y1) are high-boiling aliphatic hydrocarbons having a boiling point of at least 175° C. and preferably a flashpoint ≥60° C. Suitable hydrocarbons having a flashpoint ≥60° C. include, for example, n-undecane (flashpoint 60° C., boiling point 196° C.) or n-dodecane (flashpoint 71° C., boiling point 216° C.). For example, it is possible to use technical grade mixtures of hydrocarbons, for example mixtures of paraffinic hydrocarbons, mixtures of paraffinic and naphthenic hydrocarbons or mixtures of isoparaffins. It will be apparent to those skilled in the art that technical grade mixtures may still comprise small residues of aromatic or unsaturated hydrocarbons. Technical grade mixtures of saturated aliphatic solvents are commercially available, for example technical grade mixtures of the Shellsol® D series or the Exxsol® D series.

In a further embodiment of the invention, the organic hydrocarbons (Y) are aromatic hydrocarbons (Y3) or mixtures thereof. Preferred hydrocarbons (Y3) are high-boiling aromatic hydrocarbons having a boiling point of at least 175° C. and preferably a flashpoint ≥60° C.

Suitable aromatic hydrocarbons having a flashpoint L 60° C. include, for example, naphthalene. It is possible with preference to use technical mixtures of aromatic hydrocarbons. Technical grade mixtures of aromatic solvents are commercially available, for example technical grade mixtures of the Shellsol® A series or the Solvesso® series.

Preferably, the organic solvents (Y) are aromatic hydrocarbons (Y3);

The concentration of the copolymers (X) in the composition of the invention is chosen by the person skilled in the art in accordance with the desired properties of the composition. The concentration of the copolymers (X) may be 15% to 75% by weight, preferably 15% to 45% by weight, more preferably 15% by weight to 30% by weight, for example 17% to 25% by weight or 18% to 22% by weight, based in each case on the sum total of all components of the composition.

In a preferred embodiment of the invention, the composition comprises at least one copolymer (X) and at least one aromatic hydrocarbon (Y3) having a boiling point of at least 175° C. and a flashpoint ≥60° C., wherein the concentration of the copolymers (X) is 15% to 30% by weight, preferably 17% by weight to 25% by weight and, for example, 18% to 22% by weight, based on the sum total of all components of the composition.

In a further preferred embodiment of the invention, the composition comprises at least one copolymer (X) and at least one aromatic hydrocarbon (Y3) having a boiling point of at least 175° C. and a flashpoint 2 60° C., wherein the concentration of the copolymers (X) is 15% to 30% by weight, preferably 17% by weight to 25% by weight and, for example, 18% to 22% by weight, based on the sum total of all components of the composition, and wherein the copolymer (X) is one of the type described, in which

- the proportion of the monomers (B1)+(B2) based on the sum total of all monomers (B) is at least 95 mol %,
- at least 95 mol % of the $R^4$ radicals are H,
- the copolymer comprises at least two different α-olefins $H_2C{=}CH{-}R^1$ where $R^1$ represents linear alkyl radicals having 16 to 30 carbon atoms, preferably 18 to 28 carbon atoms and more preferably 18 to 24 carbon atoms, and
- the copolymer comprises at least two different monomers (B1) where $R^2$ in each case comprises 16 to 32 carbon atoms, preferably 16 to 26 carbon atoms,
- $R^3$ is a radical selected from the group of
  - $R^{3b}$: branched and/or secondary alkyl radicals, preferably branched alkyl radicals having 4 to 36, preferably 4 to 30, more preferably 4 to 17, carbon atoms, and
  - $R^{3c}$: unsubstituted or alkyl-substituted, cyclic alkyl radicals having 5 to 18, preferably 6 to 10, carbon atoms, especially a cyclohexyl radical.

Process for Preparing the Copolymers (X)

The copolymers (X) of the invention can be prepared by free-radical polymerizing the monomers (A), (B) and optionally (C) mentioned with one another in the desired ratio. Techniques for free-radical polymerization are known to those skilled in the art. In this technique, previously prepared monomers (B1) and (B2) are thus used for polymerization.

In a preferred embodiment of the process, the preparation is effected by means of an at least two-stage process, wherein, in a first process step I, a polymeric reactant, formed from olefins and maleic anhydride or the corresponding methyl-substituted derivatives thereof, is provided and, in a second process step II, the maleic anhydride units of the reactant provided are esterified with alcohols in a polymer-analogous reaction. In this procedure, the repeat units of the copolymer (X) derived from the monomers (B1) and (B2) thus do not form until the polymer-analogous reaction.

Process Step I—Provision of a Polymeric Reactant from Olefins and Maleic Acid or Methyl-Substituted Maleic Acid In the course of process step I, a polymeric reactant is provided. This is a copolymer formed from the olefins (A), a monomer (B3b) and optionally further monomers (C). Preference is given to using maleic anhydride as monomer (B3b).

Suitable α-olefins $H_2C{=}CH{-}R^1$ (A) and preferred α-olefins (A), including preferred mixtures of α-olefins (A), have already been outlined.

In the polymeric reactant to be provided, the proportion of the monomers (A) based on the amount of all monomers is 40 mol % to 60 mol %, preferably 45 mol % to 55 mol % and, for example, 48 mol % to 52 mol %.

In addition, the proportion of the monomers (B3b) based on the amount of all monomers is 40 mol % to 60 mol %, preferably 45 mol % to 55 mol % and, for example, 48 to 52 mol %.

The proportion of optional monomers (C)—if they are present at all—is not more than 20 mol %, preferably not more than 10 mol %, more preferably not more than 5 mol %, and most preferably no further monomers (C) are present.

The number-average molecular weight $M_n$ of the polymeric reactant formed from olefins (A) and monomers (B3b) is generally 1000 g/mol to 15 000 g/mol.

Olefin-maleic anhydride copolymers having such number-average molecular weights $M_n$ are known in principle in the prior art and are commercially available.

The preparation can be effected in a manner known in principle by free-radical polymerization of the α-olefins (A) and of the maleic anhydride or the methyl-substituted derivatives (B3b) in the desired amounts. For example, it is possible to use the procedure described in EP 214 786 A1, especially page 6 lines 1 to 14. Polymerization is possible either in bulk or using solvent.

Suitable solvents are aprotic solvents such as xylene, aliphatics, alkanes, benzine or ketones. In a preferred embodiment of the invention, the solvents are at least one organic solvent (Y), especially a hydrocarbon, preferably hydrocarbons or hydrocarbon mixtures having a flashpoint ≥60° C.

The hydrocarbons may, for example, be saturated aliphatic hydrocarbons (Y2) or mixtures thereof. These may be either paraffinic or naphthenic, i.e. saturated cyclic, hydrocarbons. Preferred hydrocarbons (Y2) are high-boiling aliphatic hydrocarbons having a boiling point of at least 175° C. and preferably a flashpoint ≥60° C. With regard to examples and preferred hydrocarbons (Y2), reference is made to the above description of the hydrocarbons (Y2).

The hydrocarbons may also be aromatic hydrocarbons (Y3) or mixtures thereof. Preferred hydrocarbons (Y3) are high-boiling aromatic hydrocarbons having a boiling point of at least 175° C. and preferably a flashpoint 60° C. With regard to examples and preferred hydrocarbons (Y3), reference is made to the above description of the hydrocarbons (Y3).

The free-radical polymerization can be undertaken using customary, thermally decomposing initiators at 80° C. to 200° C., preferably at 100° C. to 180° C. and especially at 130° C. to 170° C. The amount of initiator is typically 0.1% to 10% by weight based on the amount of the monomers, preferably 0.2% to 5% by weight and more preferably 0.5% to 2% by weight. The polymerization time is typically 1-12 h.

The person skilled in the art is aware of how the desired range for the number-average molecular weight $M_n$ can be established. The molecular weight can be controlled in a manner known in principle via the choice of the polymerization temperature (the lower the temperature, the higher $M_n$) or via the choice of reaction medium (aromatic solvents control molecular weight to a greater degree, i.e. lower $M_n$, aliphatic solvents control molecular weight to a lesser degree, i.e. higher $M_n$, without solvent even higher $M_n$).

According to the manner of polymerization, the polymeric reactants obtained occur in solvent-free form or as a solution. After polymerization in solution, the copolymer (X) can of course be isolated from the solvent by methods known to those skilled in the art and be used as such for process step II.

In one embodiment of the invention, the polymeric reactants are prepared in hydrocarbons or hydrocarbon mixtures having a flashpoint ≥60° C., especially high-boiling aromatic hydrocarbons having a boiling point of at least 175° C. and a flashpoint ≥60° C., in which case the solution obtained is used directly for esterification in process step II without isolating the polymer. The person skilled in the art will select a suitable concentration of the monomers in the solvent for polymerization. For example, a concentration of the monomers in the solvent from 20% by weight to 80% by weight, for example 30% by weight to 60% by weight, may be chosen.

Process Step II—Esterification

The polymeric reactants provided from olefins and maleic anhydride or methylmaleic anhydride and/or dimethylmaleic anhydride are subjected to polymer-analogous esterification in a second step with at least one alcohol $R^2OH$ and at least one alcohol $R^3OH$.

In the esterification, the rings of the copolymerized anhydride groups are opened and, in a polymer-analogous reaction—according to the amount of the alcohols and the reaction conditions—the corresponding dicarboxylic monoesters or dicarboxylic diesters are formed.

The alcohols $R^2OH$ are linear aliphatic alcohols and $R^2$ is a linear 1-alkyl radical having 16 to 36 carbon atoms, preferably 16 to 32 carbon atoms, more preferably 16 to 26 carbon atoms.

Examples of alcohols $R^2OH$ include n-hexadecyl alcohol, n-octadecyl alcohol, n-nonadecyl alcohol, n-eicosyl alcohol, n-heneicosyl alcohol, n-docosyl alcohol, n-tetracosyl alcohol, n-hexacosyl alcohol, n-octacosyl alcohol or n-triacontyl alcohol. Particularly preferred alcohols are selected from the group of n-docosyl alcohol, n-tetracosyl alcohol and n-hexacosyl alcohol.

Preference is also given to using mixtures of at least two, more preferably at least three, alcohols $R^2OH$. These may especially be mixtures of naturally occurring fatty alcohols or wax alcohols. Fatty alcohols or wax alcohols from natural sources typically have an even number of carbon atoms.

In a preferred embodiment of the invention, a mixture of at least three alcohols $R^2OH$ is used, comprising at least 1-docosyl alcohol, 1-tetracosyl alcohol and 1-hexacosyl alcohol. Preferably, the amount of the three alcohols mentioned is at least 70% by weight, preferably at least 80% by weight, based on the amount of all the alcohols $R^2OH$ used.

The alcohols $R^3OH$ are at least one alcohol selected from the group of

- alcohols $R^{3a}OH$ where $R^{3a}$ represents linear alkyl radicals having 1 to 10 carbon atoms,
- alcohols $R^{3b}OH$ where $R^{3b}$ represents branched and/or secondary alkyl radicals having 4 to 36 carbon atoms,
- alcohols $R^{3c}OH$ where $R^{3c}$ represents unsubstituted or alkyl-substituted, cyclic alkyl radicals having 5 to 18 carbon atoms, and
- alcohols $R^{3d}OH$ where unsubstituted or alkyl-substituted aromatic hydrocarbyl radicals having 6 to 36 carbon atoms.

Preferred $R^{3a}$, $R^{3b}$, $R^{3c}$ and $R^{3d}$ radicals have already been mentioned above.

Examples of alcohols $R^{3a}OH$ include ethanol, n-propanol, n-butanol, n-pentanol, n-hexanol, n-heptanol, n-octanol, n-nonanol and n-decanol, preference being given to n-propanol, n-butanol, n-pentanol, n-hexanol, n-heptanol, n-octanol, n-nonanol and n-decanol, particular preference to ethanol, n-propanol, n-butanol, n-pentanol, n-hexanol, and very particular preference to n-butanol.

Examples of branched and/or secondary alcohols $R^{3b}OH$ include i-butanol, t-butanol, 2,2'-dimethylpropan-1-ol, 2-ethylhexan-1-ol, 2-propylheptan-1-ol, i-nonanol, i-decanol, i-tridecanol or i-heptadecanol, 2-butanol, 2-heptanol, 2-hexanol, 2-octanol or 2-decanol, preference being given to t-butanol, 2-ethylhexan-1-ol and 2-propylheptan-1-ol and i-heptadecanol.

Examples of alcohols $R^{3c}OH$ include cyclopentanol, cyclohexanol, cycloheptanol, borneol, isoborneol, menthol, neomenthol, isomenthol, neoisomenthol, or myrtanol.

Examples of alcohols $R^{3d}$ include phenol, toluene or benzyl alcohol.

In one embodiment of the invention, the alcohols $R^3OH$ are alcohols $R^{3a}OH$.

In one embodiment of the invention, the alcohols $R^3OH$ are alcohols $R^{3b}OH$ and/or alcohols $R^{3c}OH$.

In one embodiment of the invention, the alcohols $R^3OH$ are alcohols $R^{3b}OH$.

In one embodiment of the invention, the alcohols $R^3OH$ are alcohols $R^{3c}OH$.

In one embodiment of the invention, the alcohols $R^3OH$ are alcohols $R^{3d}OH$.

According to the invention, the proportion of the alcohols $R^3OH$ based on the sum total of the alcohols $R^2OH$ and $R^3OH$ used for esterification is 1 mol % to 49 mol %, preferably 5 mol % to 45 mol %, 20 mol % to 45 mol % and, for example, 30 mol % to 40 mol %.

In addition, the amount of the alcohols $R^2OH$ and $R^3OH$ used together is 0.5 to 1.5 mol/mol of anhydride units in the copolymer (X), preferably 0.8 to 1.2 mol/mol, more preferably 0.9 to 1.1 mol/mol, most preferably 0.95 to 1.05 mol/mol.

The polymer-analogous esterification is generally conducted at a temperature of 130° C. to 180° C., preferably 140° C. to 160° C.

The esterification can be conducted in bulk or else in the presence of inert solvents. The reaction mixture should remain liquid and homogeneous at the reaction temperature in order to assure a homogeneous reaction. The reaction can be run at ambient pressure or under pressure.

The alcohols may be initially charged in full or else added sequentially. The esterification can be undertaken, for example, in the presence of esterification catalysts, for example para-toluenesulfonic acid, methanesulfonic acid or sulfuric acid. A suitable procedure is disclosed, for example, in WO 2014/095408 A1. The amount may be 0.05 to 0.5 mol % based on the alcohols.

If process step I is conducted in solvents, it is advantageously possible to use a solution of the polymeric reactants obtained in the course of process step I for process step II. Otherwise, the polymeric reactants for process step II are dissolved in suitable inert solvents.

Preferably, the esterification is conducted in hydrocarbons, preferably in hydrocarbons or hydrocarbon mixtures having a flashpoint ≥60° C. In this implementation, the esterification directly gives the composition of the invention, composed of at least one copolymer (X) and at least one hydrocarbon.

The hydrocarbons may, for example, be saturated aliphatic hydrocarbons (Y2) or mixtures thereof. These may be either paraffinic or naphthenic, i.e. saturated cyclic, hydrocarbons.

Preferred hydrocarbons (Y2) are high-boiling aliphatic hydrocarbons having a boiling point of at least 175° C. and preferably a flashpoint ≥60° C. With regard to examples and preferred hydrocarbons (Y2), reference is made to the above description of the hydrocarbons (Y2).

The hydrocarbons may also be aromatic hydrocarbons (Y3) or mixtures thereof. Preferred hydrocarbons (Y3) are high-boiling aromatic hydrocarbons having a boiling point of at least 175° C. and preferably a flashpoint ≥60° C. With regard to examples and preferred hydrocarbons (Y3), reference is made to the above description of the hydrocarbons (Y3).

In a preferred embodiment of the invention, process step II is conducted in solution and the amount of the hydrocarbons used is such as to give a composition composed of at least one copolymer (X) and at least one hydrocarbon in a concentration of 15% to 85% by weight. It is possible to directly prepare a ready-to-use composition in the concentrations as described above, or it is possible to prepare a concentrate, for example having a concentration of 50% to 70% by weight, which then still has to be diluted further on site to the ready-to-use concentration.

The invention further relates to copolymers (X) obtainable by the process just described. With regard to the process parameters, reference is made to the process just described.

The invention relates more particularly to copolymers (X) comprising, as monomers, at least (A) 40 to 60 mol %, based on the amount of all monomers, of at least one α-olefin (A) of the general formula $H_2C{=}CH{-}R^1$ where $R^1$ is at least one linear, cyclic or branched, aliphatic and/or aromatic hydrocarbyl radical having 14 to 50 carbon atoms, and (B) 60 to 40 mol %, based on the amount of all monomers, of monoethylenically unsaturated dicarboxylic acids or derivatives thereof, and wherein the monomers (B) are (B1) at least one monomer $(R^2OOC)R^5C{=}CR^6(COOR^4)$, (B2) at least one monomer $(R^3OOC)R^5C{=}CR^6(COOR^4)$ and (B3) optionally at least one monomer selected from the group of $(HOOC)R^5C{=}CR^6(COOH)$ (B3a) and

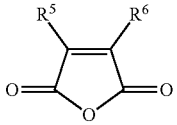

(B3b)

where $R^2$ is a linear alkyl radical having 16 to 36 carbon atoms, $R^3$ is a radical selected from the group consisting of $R^{3a}$: linear 1-alkyl radicals having 1 to 10 carbon atoms, $R^{3b}$: branched and/or secondary alkyl radicals having 4 to 36 carbon atoms, $R^{3c}$: unsubstituted or alkyl-substituted, cyclic alkyl radicals having 5 to 18 carbon atoms, or $R^{3d}$: unsubstituted or alkyl-substituted, aromatic hydrocarbyl radicals having 6 to 36 carbon atoms, $R^4$ in each case is a radical selected from the group of H, $R^2$ and $R^3$, with the proviso that at least 50 mol % of the $R^4$ radicals are H, $R^5$ and $R^6$ are each H or methyl, the proportion of the $R^3$ radicals based on the sum total of the $R^2$ and $R^3$ radicals is 1 mol % to 49 mol %, the proportion of the monomers (B1)+(B2) based on the sum total of all monomers (B) is at least 50 mol %, and the weight-average molecular weight $M_w$ of the copolymers (X) is 2000 g/mol to 25 000 g/mol, wherein the copolymers (X) are obtainable by the process just described.

Use of the Copolymers (X) as a Pour Point Depressant

The inventive copolymers (X) can be used as pour point depressants for crude oil, mineral oil and/or mineral oil products, by adding at least one of the copolymers (X) detailed to the crude oil, mineral oil and/or mineral oil products.

In a preferred embodiment of the invention, the inventive copolymers (X) are used as pour point depressants for crude oil, by adding at least one of the copolymers (X) outlined to the crude oil.

Pour point depressants reduce the pour point of crude oils, mineral oils and/or mineral oil products. The pour point refers to the lowest temperature at which a sample of an oil, in the course of cooling, still just flows. For the measurement of the pour point, standardized test methods are used.

For the inventive use, the copolymers (X) can be used as such. But preference is given to using the inventive copolymers (X) in the form of a solution. More particularly, it is possible to use formulations of the copolymers (X) which, as well as solvents, may also comprise further components. The inventive copolymers (X) should be homogeneously dispersed, preferably dissolved, in the solvents used. In principle, all solvents which meet these requirements are suitable. It is of course also possible to use mixtures of different solvents.

One embodiment of the invention concerns at least one organic solvent (Y), preferably an organic solvent having a flashpoint ≥60° C.

In one embodiment of the invention, the organic solvents are nonpolar solvents (Y1) comprising saturated aliphatic hydrocarbyl groups, preferably those having a flashpoint ≥60° C. Examples of such solvents (Y1) include saturated aliphatic alcohols or esters of saturated aliphatic carboxylic acids and saturated aliphatic alcohols, with the proviso that the solvents preferably each have a flashpoint ≥60° C. Examples of esters comprise esters of saturated fatty acids having at least 8 carbon atoms with saturated aliphatic alcohols, for example methyl laurate or methyl stearate. Technical grade mixtures of various aliphatic esters are commercially available. In one embodiment of the invention, solvents used may be esters of aliphatic or cycloaliphatic dicarboxylic acids, for example dialkyl esters of cyclohexane-1,2-dicarboxylic acid, such as diisononyl cyclohexane-1,2-dicarboxylate.

In one embodiment of the invention, the organic solvents are saturated aliphatic hydrocarbons (Y2) or mixtures thereof. These may be either paraffinic or naphthenic, i.e. saturated cyclic, hydrocarbons. Preferred hydrocarbons (Y2) are high-boiling aliphatic hydrocarbons having a boiling point of at least 175° C. and preferably a flashpoint ≥60° C. With regard to examples and preferred hydrocarbons (Y2), reference is made to the above description of the hydrocarbons (Y2).

In a further embodiment of the invention, the organic solvents are aromatic hydrocarbons (Y3) or mixtures thereof. Preferred hydrocarbons (Y3) are high-boiling aromatic hydrocarbons having a boiling point of at least 175° C. and preferably a flashpoint ≥60° C. With regard to examples and preferred hydrocarbons (Y3), reference is made to the above description of the hydrocarbons (Y3).

For example, it is possible to use the above-described compositions composed of copolymers (X) and organic solvents (Y), preferably hydrocarbons. It is advantageously possible to obtain such compositions by—as likewise described above—using hydrocarbons, especially hydrocarbons or hydrocarbon mixtures having a flashpoint 60° C. directly for preparation of the copolymers (X).

Ready-to-use formulations of the copolymers (X) may of course also comprise further components. For example, additional wax dispersants can be added to the formulation. Wax dispersants stabilize paraffin crystals which have formed and prevent them from sedimenting. Wax dispersants used may, for example, be alkylphenols, alkylphenol-formaldehyde resins or organic sulfonic acids, for example dodecylbenzenesulfonic acid.

The concentration of the copolymers (X) in ready-to-use formulations may be 0.5% to 45% by weight, preferably 15% to 45% by weight, more preferably 15% by weight to 30% by weight, for example 17% to 25% by weight or 18% to 22% by weight, based in each case on the sum total of all components of the composition.

For production of ready-to-use formulations, it is especially possible to use the above-described compositions composed of copolymers (X) and organic solvents (Y), preferably hydrocarbons. These can be mixed—preferably on site—with further components and optionally further solvent.

While the preparation of copolymers (X) and optionally of a concentrate of the copolymers (X) in solvents is naturally effected in a chemical plant, there are multiple options with regard to the ready-to-use formulation. Advantageously, the ready-to-use formulation can be prepared as close as possible to the site where the formulation is to be injected.

The amount of inventive copolymers (X) added to the crude oil, mineral oil and/or mineral oil products, preferably to the crude oil, is judged by the person skilled in the art such that the desired lowering of the pour point is achieved, it being obvious to the person skilled in the art that the amount necessary is dependent on the nature of the crude oil. On the other hand, it is desirable for economic reasons to use a minimum amount of pour point depressant.

It has been found to be useful to use the copolymers (X) in an amount of 50 to 1500 ppm based on the crude oil, mineral oil and/or mineral oil products. The amount is preferably 100 to 1000 ppm, more preferably 250 to 600 ppm and, for example, 300 to 600 ppm. The stated amounts are based on the copolymer (X) itself.

In a preferred embodiment of the invention, the oil is crude oil.

It is advisable here to add the copolymers (X) or solutions or formulations thereof to the crude oil before the precipitation of waxes has commenced, i.e. at a temperature above the pour point.

For example, the addition can be effected at a temperature of not less than 10° C. above the pour point.

The site of addition of the copolymers (X) to the crude oil is suitably chosen by the person skilled in the art. The addition can be effected, for example, in the formation, in the well, at the wellhead or to a pipeline.

In one embodiment, copolymers (X) or solutions or formulations thereof are injected into a crude oil pipeline. The injection can preferably be effected at the oilfield, i.e. at the start of the crude oil pipeline, but the injection can of course also be effected at another site. For example, the pipeline may be one leading onshore from an offshore platform. The copolymers (X) can prevent blockage of pipelines if the crude oil cools down in the course of transport in the pipeline. This risk is naturally particularly pronounced when the pipeline is one in a cold environment, for example in an Arctic environment.

In a further embodiment of the invention, the copolymers (X) or solutions or formulations thereof are injected into a production well. In one embodiment, the production well may be an offshore production well. The injection can be effected, for instance, at the site where oil flows out of the formation into the production well. In this manner, the solidification of the crude oil in the production well and in downstream transport pipelines, an excessive increase in the viscosity thereof and the constriction of pipe cross sections by paraffin deposits can be prevented.

In one embodiment of the invention, the injection can be effected in an umbilical manner. This involves introducing a flexible string comprising at least one pipeline and optionally electrical wires or control wires in a protective shell axially into a well or a pipeline. The formulation of the copolymers (X) can be injected exactly at the desired site by pipeline in the flexible string.

Further Uses of the Copolymers (X)

The inventive copolymers (X) can of course also be used for other purposes.

In a further embodiment of the invention, the above-described copolymers (X) or solutions or formulations thereof are used to prevent wax deposits on surfaces in contact with crude oil, mineral oil and/or mineral oil products. These are preferably surfaces in contact with crude oil. The use is effected by adding at least one of the copolymers (X) or solutions or formulations thereof to the crude oil, mineral oil and/or mineral oil products. Preferred solutions and formulations have already been mentioned, and the manner of use is also analogous to the use as a pour point depressant. As well as the inventive formulations, it is of course also possible to use further formulations which act as wax inhibitors.

Effects of the Invention

By virtue of the partial replacement of long-chain linear alkyl groups by short linear alkyl groups, branched alkyl groups, cyclic alkyl groups or hydrocarbyl groups, copolymers (X) are obtained, which can be processed to formulations, especially about 20% formulations, having lower solidification points than the corresponding formulations of unmodified copolymers, i.e. copolymers comprising exclusively linear alkyl groups. This makes it easier to handle formulations of this kind, especially in a relatively cold environment, for example an Arctic environment.

The examples which follow are to illustrate the invention in detail:

Starting Materials Used:

| | | | |
|---|---|---|---|
| $C_{20/24}$ olefins | commercially available mixture of α-olefins, main constituents $C_{20}$, $C_{22}$ and $C_{24}$ olefins | | |
| | $C_{18}$ | <3% | by wt. |
| | $C_{20}$ | 35% to 55% | by wt. |
| | $C_{22}$ | 25% to 45% | by wt. |
| | $C_{24}$ | 10% to 26% | by wt. |
| | $C_{26}$ | <2% | by wt. |
| | $>C_{26}$ | <0.1% | by wt. |
| Alcohol mixture I $C_{16/22}$ alcohols | commercially available mixture of linear alcohols, main constituents $C_{16}$ to $C_{22}$ alcohols | | |
| | $C_{16/18}$ | 16% to 21% | by wt. |
| | $C_{20}$ | 24% to 27% | by wt. |
| | $C_{22}$ | 24% to 28% | by wt. |
| | $C_{24}$ | 2% to 8% | by wt. |
| | $>C_{26}$ | <5% | by wt. |
| | $C_{28/30}$ | <3% | by wt. |
| Alcohol mixture II $C_{22/26}$ alcohols | commercially available mixture of linear alcohols, main constituents $C_{22}$ to $C_{26}$ alcohols | | |
| | $C_{18}$ | <1% | by wt. |
| | $C_{20}$ | <10% | by wt. |
| | $C_{22}$ | <55 +/− 10% | by wt. |
| | $C_{24}$ | 25 +/− 6% | by wt. |
| | $C_{26}$ | <13 +/− 4% | by wt. |
| | $C_{28}$ | <9% | by wt. |
| Solvesso ® 150 | high-boiling aromatic hydrocarbon mixture from ExxonMobil Chemical Company, aromatics content >99% by vol., initial boiling point 181° C., flashpoint to ASTM D 93 66° C. | | |
| 1-isotridecanol | $C_{13}$ alcohol having an average of 3 branches | | |
| 1-isoheptadecanol | $C_{17}$ alcohol having an average of 3 branches | | |

Preparation of Unmodified Olefin-MA Copolymers

Copolymer I $C_{20/24}$ olefins+MA, 1:1 molar, no solvent

For the polymerization, a four-neck flask with stirrer, internal thermometer, nitrogen inlet and reflux condenser and with feeds for maleic anhydride and initiator was used.

Melt 1 mol of maleic anhydride at 80° C. in a heatable dropping funnel. While sparging with $N_2$, heat an initial charge comprising 1 mol of $C_{20/24}$ olefin to an internal temperature of 150° C., then meter in maleic anhydride and 1 mol % (based on monomers) of di-tert-butyl peroxide from separate feeds over the course of 5 h. Then polymerize further at an internal temperature of 150° C. for 1 h.

An olefin-MA copolymer (X) having a number-average molecular weight $M_n$ of 10 000 g/mol is obtained.

Copolymer II $C_{20/24}$ olefins+MA, 1:1.14 molar, in aliphatic solvents

The same apparatus as for synthesis of the copolymer (X) I is used.

Melt 1.1 mol of maleic anhydride at 80° C. in a heatable dropping funnel. While sparging with $N_2$, charge flask with Solvesso® 150. Heat 1 mol of $C_{20/24}$ olefin to an internal temperature of 150° C., then meter in maleic anhydride and 1 mol % (based on monomers) of di-tert-butyl peroxide from separate feeds over the course of 5 h. The amount of the solvent is such as to give rise to a solution of 50% by weight of the polymer. After addition has ended, polymerize further at an internal temperature of 150° C. for 1 h.

An olefin-MA copolymer (X) having a number-average molecular weight $M_n$ of 4000 g/mol is obtained.

Methods of Measurement:

Solids Content (SC)

The solids content was determined by drying the products at 120° C. in a vacuum drying cabinet for 2 h.

Number-Average Molecular Weight $M_n$ and Weight-Average Molecular Weight $M_w$

The mass-average molecular weights and the polydispersities are determined with a GPC system at 35° C. The system comprises two columns and a refractive index detector and UV detector. The eluent used is THF with 0.1% trifluoroacetic acid. Calibration is conducted with a narrow-distribution polystyrene standard ($M_n$=580-6 870 000 g/mol).

Pour Point 300 ppm in Oil

The determination of the pour point was conducted to ASTM D 5853 "Test Method for Pour Point of Crude Oils". The pour point is the minimum temperature at which a sample of a tested oil is still just free-flowing. According to ASTM D 5853, for this purpose, a sample of the oil is cooled in steps of 3° C. each and the flowability is tested after each step. For the tests, a crude oil from the "Landau" oilfield in south-west Germany (Wintershall Holding GmbH) having an API gravity of 37 and a pour point of 27° C. was used. To determine the lowering of the pour point, the polymers to be tested were used to the oil in a concentration of 300 ppm of polymer based on the crude oil.

PP 20% Pure

In a further measurement, the pour point of a 20% solution of the polymer of the invention itself was measured. The solutions obtained were diluted to a concentration of 20% by weight using Solvesso® 150. The pour point is the minimum temperature at which the 20% solution is still just free-flowing.

The determination of the 20% pour point was conducted according to ASTM D5985-02 (approved Jan. 1, 2014).

No-Flow 20% Pure

In a further measurement, the no-flow point of a 20% solution of the polymer of the invention itself was measured. The solutions obtained were diluted to a concentration of 20% by weight using Solvesso® 150. The no-flow point is the temperature at which the 20% solution is just no longer free-flowing.

The determination of the 20% pour point was conducted according to ASTM D 7346-15 (approved Jul. 1, 2015).

First Series of Experiments: Copolymer I, $C_{16/22}$ Alcohols

COMPARATIVE EXPERIMENT 1 (WITHOUT ALCOHOL 2)

For the polymerization, a four-neck flask with stirrer, internal thermometer, nitrogen inlet and reflux condenser and a feed for Solvesso® 150 was used.

15 g of copolymer I (15 g) and 13.77 g of alcohol mixture I ($C_{16/22}$ alcohols) are melted at an external temperature of 85° C. and, after the melting, 7.19 g of Solvesso® 150 are added. Heat to external temperature 150° C. and stir for 4 h.

EXPERIMENT 1

The same apparatus is used as in comparative experiment 1.

45 g of copolymer I and 11.71 g of isoheptadecanol are melted at an external temperature of 85° C. and, after the melting, 20.54 g of Solvesso® 150 and 10 mg of para-toluenesulfonic acid are added. Heat to external temperature 150° C. and stir for 2 h. Then 25.45 g of alcohol mixture I ($C_{16/22}$ alcohols) are added and the mixture is stirred for a further 4 h.

EXPERIMENT 2

The same apparatus is used as in comparative experiment 1.

130.18 g of copolymer I and 17.20 g of 2-ethylhexanol are melted at an external temperature of 85° C. and, after the melting, 54.26 g of Solvesso® 150 and 30 mg of para-toluenesulfonic acid are added. Heat to external temperature 150° C. and stir for 2 h. Then 73.62 g of alcohol mixture I ($C_{16/22}$ alcohols) are added and the mixture is stirred for a further 4 h.

The test parameters and the results are collated in table 1.

EXPERIMENT 3

The same apparatus is used as in comparative experiment 1.

240 g of copolymer 1, 158.30 g of alcohol mixture I ($C_{16/22}$ alcohols) and 18.34 g of cyclohexanol are melted at an external temperature of 85° C. and, after the melting, 104.16 g of Solvesso® 150 are added. Heat to external temperature 150° C. and stir for 4 h.

EXPERIMENT 4

The same apparatus is used as in comparative experiment 1.

130.18 g of copolymer I and 13.23 g of cyclohexanol are melted at an external temperature of 85° C. and, after the melting, 54.26 g of Solvesso® 150 and 30 mg of para-toluenesulfonic acid are added. Heat to external temperature 150° C. and stir for 2 h. Then 73.62 g of alcohol mixture I ($C_{16/22}$ alcohols) are added and the mixture is stirred for a further 4 h.

COMPARATIVE EXPERIMENT 2 (MORE THAN 49 MOL % OF ALCOHOL 2)

The same apparatus is used as in comparative experiment 1.

25 g of copolymer I and 3.18 g of cyclohexanol are melted at an external temperature of 85° C. and, after the melting, 9.99 g of Solvesso® 150 and 10 mg of para-toluenesulfonic acid are added. Heat to external temperature 150° C. and stir for 2 h. Then 11.78 g of alcohol mixture I ($C_{16/22}$ alcohols) are added and the mixture is stirred for a further 4 h.

Second Series of Experiments: Copolymer II, $C_{222/26}$ Alcohols

COMPARATIVE EXPERIMENT 3 (WITHOUT ALCOHOL 2)

The same apparatus is used as in comparative experiment 1.

15.0 g of a 50% solution of copolymer II in Solvesso® 150 and 9.45 g of alcohol mixture II ($C_{22/26}$ alcohols) are melted at an external temperature of 85° C. Heat to external temperature 150° C. and stir for 6 h.

EXPERIMENT 5

The same apparatus is used as in comparative experiment 1.

15.0 g of a 50% solution of copolymer II in Solvesso® 150 and 0.77 g of cyclohexanol are melted at an external temperature of 85° C. and, after the melting, 10 mg of para-toluenesulfonic acid are added. Heat to external temperature 150° C. and stir for 2 h. Then 5.67 g of alcohol mixture II ($C_{22/26}$ alcohols) are added and the mixture is stirred for a further 4 h.

The test parameters and the results are collated in table 2.

TABLE 1

Experimental parameters and results with copolymers (X) based on the olefin-MA copolymers I
Two results in one column are double determinations.

| No. | MA-olefin type | Alcohol 1 | Alcohol 2 | Molar ratios: Olefin/MA/alc1/alc2 | Alc 2/Σ alc | Σ Alc/MA | $M_w$ [g/mol] | SC [%] | PP[1] 300 ppm in oil [° C.] | PP 20% [° C.] | No-flow point 20% [° C.] |
|---|---|---|---|---|---|---|---|---|---|---|---|
| C1 | I | $C_{16/22}$ | — | 1/1/1/0 | 1 | 1 | 17 200 | 80.4 | 9; 12 | 9; 9 | 6.2; 6.5 |
| 1 | I | $C_{16/22}$ | 1-isohepta-decanol | 1/1/0.6/0.4 | 0.4 | 1 | 15 800 | 77.0 | 9; 12 | −3; −3 | −4.2; −4.1 |
| 2 | I | $C_{16/22}$ | 2-ethylhexanol | 1/1/0.6/0.4 | 0.4 | 1 | 15 100 | 77.1 | 12; 12 | 3; 3 | 1.5; 1.3 |
| 3 | I | $C_{16/22}$ | cyclohexanol | 1/1/0.7/0.3 | 0.3 | 1 | 16 300 | 79.3 | 2; 15 | 3; 3 | 1.9; 1.8 |
| 4 | I | $C_{16/22}$ | cyclohexanol | 1/1/0.6/0.4 | 0.4 | 1 | 15 700 | 78.5 | 9; 9 | 0; 0 | −1.4; −1.4 |
| C2 | I | $C_{16/22}$ | cyclohexanol | 1/1/0.5/0.5 | 0.5 | 1 | 15 900 | 80.8 | 18; 18 | −3; −3 | −5.8; −5.0 |

[1]The pour point of the oil without addition of a pour point depressant is 27° C.

TABLE 2

Experimental parameters and results with copolymers (X) based on the olefin-MA copolymers II

| No. | MA-olefin type | Alcohol 1 | Alcohol 2 | Molar ratios: olefin/MA/alc1/alc2 | Alc 2/Σalc | Σ Alc/MA | $M_w$ [g/mol] | SC % | PPD 300 ppm in oil | PP 20% pure in ° C. | No-flow 20% pure in ° C. |
|---|---|---|---|---|---|---|---|---|---|---|---|
| C3 | II | $C_{22/26}$ | — | 1/1.1/1.1/0 | 1 | 1 | 5440 | 69.2 | 9; 12 | 0.5; −0.1 | 0; 0 |
| 5 | II | $C_{22/26}$ | cyclohexanol | 1/1.1/0.66/0.44 | 0.4 | 1 | 6500 | 66 | 9; 9 | 0; 0 | −1.2; −0.9 |

In the experiments, firstly, the effect of the copolymers of the invention as a pour point depressant for crude oil was determined (addition of 300 ppm of polymer in each case to the oil). The pour point of the straight crude oil is 27° C.

In addition, the properties of a 20% solution of the copolymers in high-boiling hydrocarbons were determined, by determining the pour point of the solution itself, and also the temperature from which the solution no longer flows ("no-flow point").

In comparative experiment 1 (table 1), a product according to prior art was used, namely a product based on the MA-olefin copolymer I in which the MA units are opened with a linear $C_{16/22}$ alcohol only. The copolymer lowers the pour point of the crude oil tested from 27° C. to 9 to 12° C., but the 20% solution already solidifies at about 6.5° C. and the pour point of the 20% solution is 9° C.

If the linear $C_{16/22}$ alcohol is replaced (experiment 1, table 1) by a mixture of a linear $C_{16/22}$ alcohol (60 mol %) and a branched aliphatic $C_{17}$ alcohol (40 mol %), the effect as a pour point depressant for crude oil remains unchanged. But the pour point of the 20% solution goes down to −3° C. and the 20% solution does not solidify until about −4° C. The 20% solution of the modified copolymer can thus still be handled at lower temperatures than the solution of the unmodified copolymer in comparative experiment 1.

If 2-ethylhexanol is used as branched alcohol (experiment 2), improved products are likewise obtained, but no longer to such a significant degree as in experiment 1.

Examples 3, 4 and C2 show the effect when the linear alcohol is partly replaced by cyclohexanol (30, 40 and 50 mol %). With increasing amount of cyclohexanol, the temperature at which the 20% solution solidifies becomes ever lower. In the case of the product with 50 mol % of cyclohexanol (comparative experiment 2), the solidification temperature of the 20% solution is −5° C./−5.8° C., but there is a distinct decrease in the effect as a pour point depressant for crude oil (only a lowering from 27° C. to 18° C., rather than from 27° C. to 9 to 12° C. as in the case of the unmodified product). The amount of cyclohexanol should accordingly be less than 50 mol %.

In table 2, linear $C_{22/26}$ alcohols rather than linear $C_{16/22}$ alcohols were used for opening of the MA units. Comparative experiment 3 and experiment 5 show that the partial replacement of the linear $C_{22/26}$ alcohols here too lowers as the solidification point of an about 20% solution, albeit not as significantly as in the case of use of $C_{16/22}$ alcohols.

The invention claimed is:

1. A copolymer (X) comprising, as monomers, at least (A) 40 to 60 mol %, based on the amount of all monomers, of at least one α-olefin (A) of the formula $H_2C{=}CH{-}R^1$ where $R^1$ is at least one linear, cyclic or branched, aliphatic and/or aromatic hydrocarbyl radical having 14 to 50 carbon atoms, and (B) 60 to 40 mol %, based on the amount of all monomers, of monoethylenically unsaturated dicarboxylic acids or derivatives thereof, wherein the monomers (B) are (B1) at least one monomer $(R^2OOC)R^5C{=}CR^6(COOR^4)$, (B2) at least one monomer $(R^3OOC)R^5C{=}CR^6(COOR^4)$ and (B3) optionally at least one monomer selected from the group of $(HOOC)R^5C{=}CR^6(COOH)$ (B3a) and (B3b)

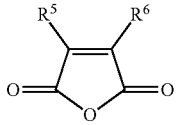

where $R^2$ is a linear alkyl radical having 16 to 36 carbon atoms, $R^3$ is a radical selected from the group consisting of $R^3a$: linear 1-alkyl radicals having 1 to 10 carbon atoms, $R^{3b}$: branched and/or secondary alkyl radicals having 4 to 30 carbon atoms, $R^{3c}$: unsubstituted or alkyl-substituted, cyclic alkyl radicals having 5 to 18 carbon atoms, and $R^{3d}$: unsubstituted or alkyl-substituted, aromatic hydrocarbyl radicals having 6 to 36 carbon atoms, $R^4$ in each case independently is a radical selected from the group consisting of H, $R^2$ and $R^3$, with the proviso that at least 50 mol % of the $R^4$ radicals are H, $R^5$ and $R^6$ are each H, the proportion of the $R^3$ radicals based on the sum total of the $R^2$ and $R^3$ radicals is 5 mol % to 45 mol %, the proportion of the monomers (B1)+(B2) based on the sum total of all monomers (B) is at least 50 mol %, and the weight-average molecular weight $M_w$, of the copolymers (X) is 2000 g/mol to 25000 g/mol.

2. The copolymer (X) according to claim 1, wherein the proportion of the monomers (B1)+(B2) based on the sum total of all monomers (B) is at least 95 mol %, and at least 95 mol % of the $R^4$ radicals are H.

3. The copolymer (X) according to claim 1, wherein $R^1$ comprises linear alkyl radicals.

4. The copolymer (X) according to claim 1, wherein the copolymer comprises at least two different α-olefins (A) $H_2C{=}CH{-}R^1$ where $R^1$ represents linear alkyl radicals having 18 to 30 carbon atoms.

5. The copolymer (X) according to claim 1, wherein the copolymer comprises at least three different α-olefins (A) $H_2C{=}CH{-}R^1$ where $R^1$ comprises n-octadecyl, n-eicosyl and n-docosyl radicals.

6. The copolymer (X) according to claim 1, wherein $R^2$ is a linear alkyl radical having 18 to 32 carbon atoms.

7. The copolymer (X) according to claim 1, wherein the copolymer comprises at least two different monomers (B1) where $R^2$ in each case is a linear alkyl radical having 18 to 32 carbon atoms.

8. The copolymer (X) according to claim 1, wherein the copolymer comprises at least three different monomers (B1) where the $R^2$ radicals in each case are n-docosyl, n-tetracosyl and n-hexacosyl radicals.

9. The copolymer (X) according to claim 1, wherein $R^3$ is $R^{3b}$ or $R^{3c}$.

10. The copolymer (X) according to claim 1, wherein $R^3$ is $R^{3b}$.

11. The copolymer (X) according to claim 1, wherein the weight average molecular weight of the copolymer (X) is 10,000 g/mol to 25,000 g/mol.

* * * * *